US005956782A

United States Patent [19]

Olguin

[11] Patent Number: 5,956,782

[45] Date of Patent: Sep. 28, 1999

[54] FEMALE CHAIR URINAL

[76] Inventor: Eugene Olguin, 1523 22nd St., Ogden, Utah 84401

[21] Appl. No.: 08/980,814

[22] Filed: Dec. 1, 1997

[51] Int. Cl.[6] ..... A61G 9/00; A47K 11/00

[52] U.S. Cl. ..... 4/454; 4/144.1; 4/450; 4/455

[58] Field of Search ..... 4/144.1–144.4, 4/114.4, 450, 454, 462, 456, 455

[56] References Cited

U.S. PATENT DOCUMENTS

| | | | |
|---|---|---|---|
| 412,734 | 10/1889 | Drahos | 4/450 |
| 2,666,209 | 1/1954 | Sherva | 4/144.1 |
| 3,383,713 | 5/1968 | Adams | 4/144.1 |
| 4,050,103 | 9/1977 | Nakao et al. | 4/144.3 |

FOREIGN PATENT DOCUMENTS

| | | | |
|---|---|---|---|
| 892451 | 4/1944 | France | 4/456 |
| 2707408 | 8/1978 | Germany | 4/144.1 |

*Primary Examiner*—Henry J. Recla
*Assistant Examiner*—Tuan Nguyen
*Attorney, Agent, or Firm*—Mallinckrodt & Mallinckrodt

[57] ABSTRACT

A urinal device for use by female persons not having the use of their legs while seated in a chair or wheelchair. The urinal device has a pie-slice shaped shallow pan with a swollen, bulbous cross-section lip completely around the periphery thereof and a perforated splash plate. A handle is affixed to the pan opposite the narrow end of the pan so that the impaired person may insert the pan beneath her body without lifting her body or legs from the chair seat. The pan is continuously drained during use by means of a drainage hose connected to a urine receiving container.

11 Claims, 2 Drawing Sheets

FEMALE CHAIR URINAL

BACKGROUND OF THE INVENTION

1. Field

The field of the invention is urinals for handicapped females confined to chairs or wheelchairs for extended periods, and more particularly such devices which may be used by chair ridden person without aid from any nurse or other attendant.

2. Prior Art

Many patients are rendered chair or wheelchair ridden because of a disease robbing them of the use of their legs, while leaving their arms strong and free. Often, such patients are quite self-sufficient, using the mobility provided by the wheelchair to fulfill many of their needs without assistance of an attendant. However, such patients often need assistance to be moved from the wheelchair onto a commode for urinating. Prior art bed pans are typically too bulky for such patients to lift themselves onto with their arms while placing the bed pan for urination. Even if it is possible to properly place the pan, a further gymnastic effort is required to remove it after use. Nor can the pan be placed aside further than arm's length without assistance. This distance is not far enough to prevent an open bed pan from emitting detectable unpleasant odors, although the user may be able to remove herself from the vicinity of the odorous pan by use of the wheelchair.

A definite need therefore exists for a urinal for use by chair-ridden female persons who have lost the use of their legs for mobility, such needed devices being capable of easy placement beneath the patient for collection of the urine into substantially odor free storage until assistance is again available. The needed device thus must permit extended periods of unattended time.

BRIEF SUMMARY OF THE INVENTION

With the foregoing in mind, the present invention eliminates or substantially alleviates the shortcomings in prior art urination devices for chair ridden female persons, by providing a receptacle pan for the urine which may be easily placed in proper position by the leg-use-impaired female in chair or wheelchair.

The inventive female urinal comprises a shallow urine receiving pan shaped and sized to be manually thrust into position under a female person without raising her body. That is, the inventive pan is quite thin vertically, so that it may be easily forced beneath the patient's posterior, taking advantage of the compressibility of the bedding and also to a large extent of the buttocks and thighs of the user. The pan is rounded completely around the periphery thereof and the device includes, an elongate forwardly directed handle affixed thereto to aid in thrusting the pan into a urine receiving position, without lifting her body from the seat of the chair, further aided by tapering, buttock spreading shape. The urine receptacle is pie-slice shaped being tapered toward the rear of the user and is somewhat broader toward her front, so that the pan may be comfortably placed and the urine efficiently collected although the pan is very small compared to the state of the art bed pans.

To prevent overflow or spillage from the shallow pan, a flexible tube extends to a collection bottle, which may be sized to accept accumulated urine from several excretions. Preferably, the pan includes a perforated splash plate thereacross at an intermediate level.

It is therefore the object of the invention to provide a urinal which may be used by leg impaired chair or wheelchair-ridden female persons without the aid of a nurse or other attendant.

BRIEF DESCRIPTION OF THE DRAWINGS

In the drawings, which represent the best modes presently contemplated for carrying out the invention.

DETAILED DESCRIPTION OF ILLUSTRATED EMBODIMENT

Figure 1:
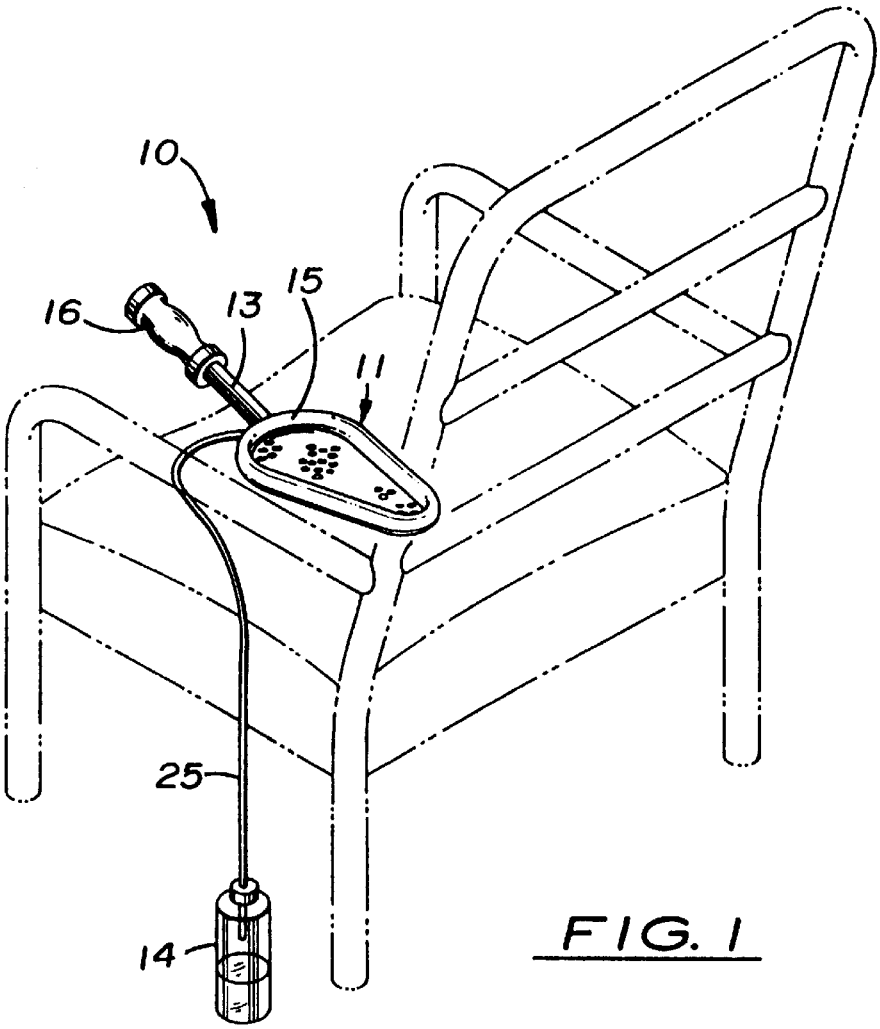
FIG. 1 is a perspective representation of the female chair urinal of the invention, with a chair associated therewith being, indicated in dashed lines, drawn to a reduced scale, FIG. 2 a view of the urinal of the invention as seen from above, drawn to approximately one-half scale, FIG. 3 a side view of a fragment of the pan of FIG. 2, said fragment being cut away to show details of the connecting handle and drain provisions of the pan, drawn to the same scale, and FIG. 4 a cross sectional view of the pan of FIG. 2, taken along line 4—4 thereof, drawn to the scale of FIG. 2.

The inventive female chair urinal device 10 includes a shallow, upwardly opening urine collection pan 11 an attached elongate handle 14, and a urine receiving and disposal bottle 13. Handle 14 is angled upwardly from front rim 15 of pan 11 and carries a conventional hand grip 16. (FIG. 1)

Figure 4:
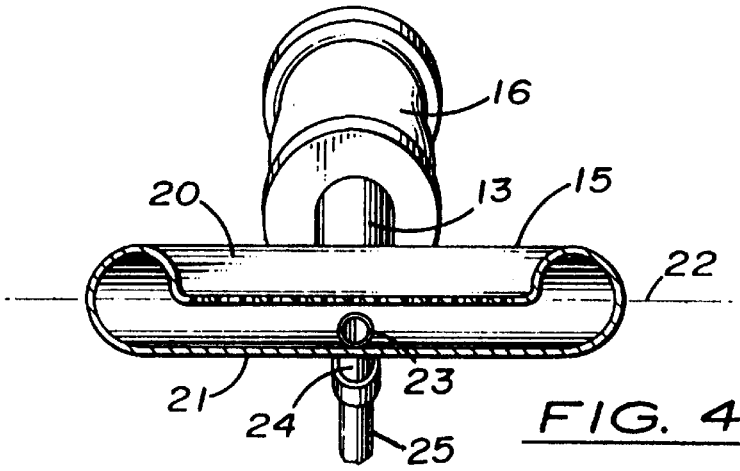
Figure 2:
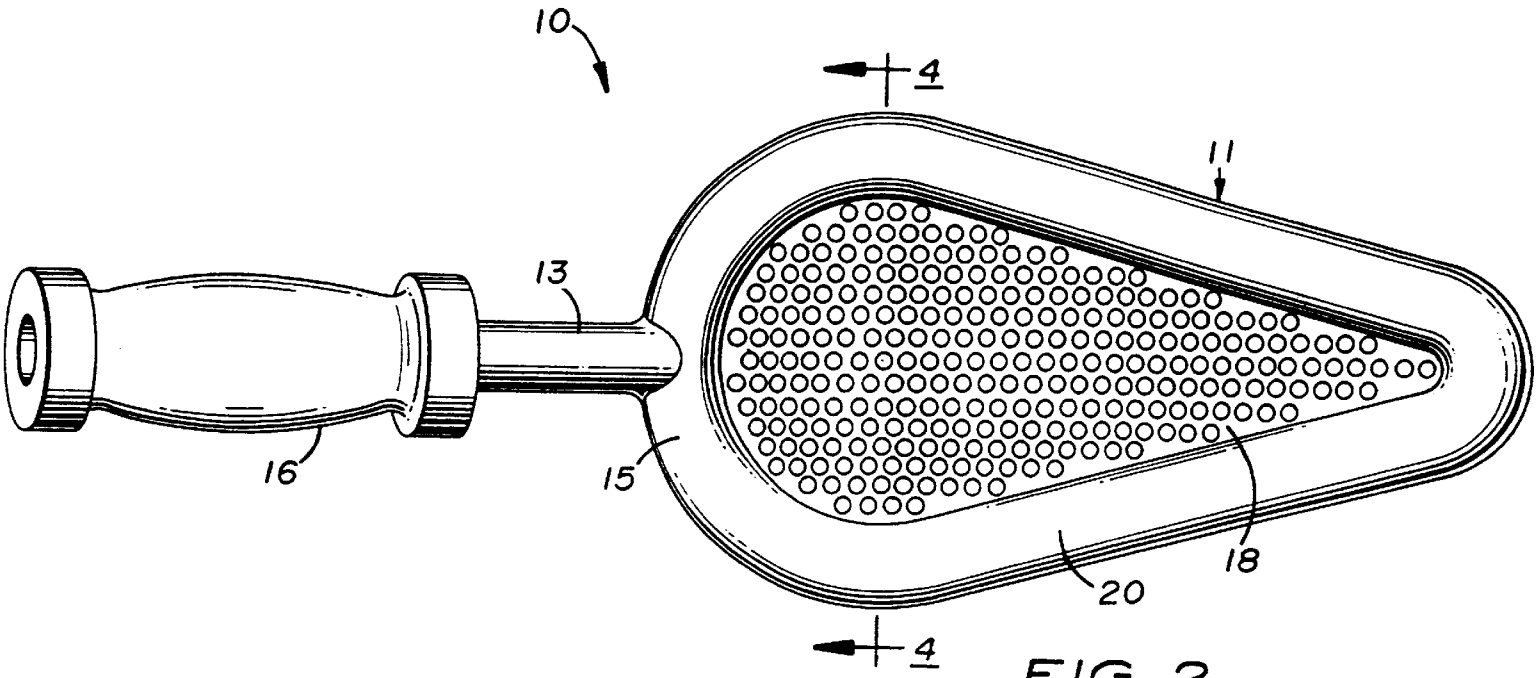
Figure 3:
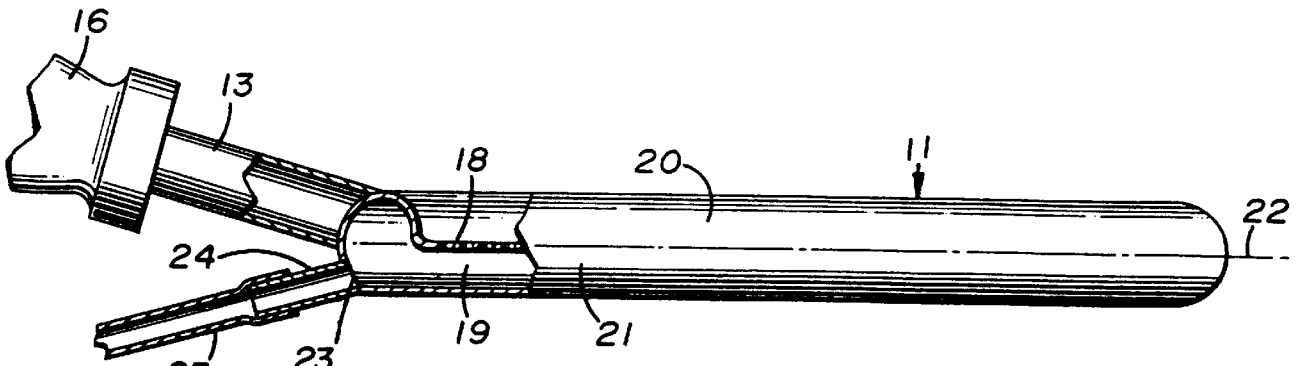

To use urinal device 10, pan 11 is inserted by the user from her front, rearwardly beneath her buttocks, employing grip 16. Pan 11 is very shallow, and carries a smoothly rounded, swollen bulbous cross-section lip continuous 17 all around its periphery. (FIGS. 2–4) Because of its size and shape, pan 11 may be inserted into a urine receiving position without any lifting of the user's legs or body from the chair seat. The tapered, rounded pie-slice shape of pan 11 when viewed from above is narrow at the rear or apex end and broad at the opposite or front end. (FIG. 2)

As indicated above, the collection pan 11 must be rounded on all surfaces that would come into contact with the skin of the patient during placement, and also on all surfaces that may during the placement for use contact the bedding or cushioning upon which the user sits. Contained within pan 11 is a perforated splash plate 18 through which the urine is passed into a lower reservoir 19.

Preferably, the pan 11 is made of corrosion resistant metal such as stainless steel, and comprises an upper half 20 and a lower half 21 which are shaped separately and later secured along a joint line 22 by welding, silver soldering, or other means, not shown, suitable for permanently joining the particular material selected. (FIGS. 3 & 4) The splash plate 18 is preferably formed as part of upper half 20 of pan 11. This eliminates most hard to clean recesses and niches which would be created if a separate screen were utilized, fastened to a molded edge portion, not shown in this embodiment, provided on upper shell 20.

Because the pan is very shallow and also very narrow to facilitate its placement for use, its urine-holding capacity is correspondingly small, so that drain provisions may be needed to prevent overflow during use. Through a hole 23 in bottom half shell 21 is disposed a small, short steel tubular connection tube 24 which is secured thereto such as by welding, silver soldering, or other suitable means, to which is connected for a surgical tubing drain hose 25 communicating with a urine collection bottle 13. Connection tube 24 is directed forwardly and down at a small angle, so as to not extend greatly below the flat bottom of pan 11. This reduces bending pressure on connection tube 24 and facilitates placement of pan 11 for use.

The inventive apparatus may be embodied in other specific forms without departing from the spirit or essential characteristics thereof. The present apparatus is therefore to be considered illustrative and not restrictive, the scope of the invention being indicated by the appended claims rather than by the foregoing description and all equivalencies of the claims are therefore intended to be embraced therein.

What is claimed and desired to be secured by United States Letters Patent is:

1. A urinal device for receiving urine from a female person while in a seated position and holding the urine, which device slides into a urine receiving position from the person's front side between her body and a supporting seat surface to receive the urine and which is subsequently removed from such urine receiving position, the female person remaining seated the entire time, comprising:

a shallow, upwardly opening pan of a rounded pie-slice configuration with a generally flat bottom and a continuous swollen, bulbous cross-section lip around the periphery thereof, said pan having a radiused apex end and a larger radiused opposite end; and an elongate handle attached at one end directly to said lip and extending from said opposite end of said pan in a direction opposite from said apex end and angled upwardly from said lip, said handle being for gripping by a person to slide the urinal device into and out of the urine receiving position.

2. A urinal device according to claim 1, further comprising:

a connection tube connected to and extending from the pan generally adjacent to and below the handle, said connection tube which communicates between an interior and an exterior of said pan;

a urine receiving container; and a flexible hose which connects together said connection tube and said urine receiving container, which container receives and stores urine from said interior of said pan.

3. A urinal device according to claim 2, wherein a grip is disposed about at least a portion of the handle.

4. A urinal device according to claim 1, further comprising a perforated splash plate attached at an outer periphery thereof to a continuous inside portion of the bulbous lip, said splash plate extending generally parallel to the bottom of the pan and which along with said bottom and said bulbous lip define a lower reservoir therebetween for receiving urine through said perforated splash plate.

5. A urinal device according to claim 4, wherein the handle is angled upwardly from the end connected to the bulbous lip toward the opposite end thereof.

6. A urinal device according to claim 4, wherein a grip is disposed about at least a portion of the handle.

7. A urinal device according to claim 4, further comprising:

a connection tube connected to and extending from the pan generally adjacent to and below the handle, said connection tube which communicates between an interior and an exterior of said pan;

a urine receiving container; and a flexible hose which connects together said connection tube and said urine receiving container, which container receives and stores urine from said interior of said pan.

8. A urinal device for receiving urine from a female person while in a seated position and holding the urine, which device slides into a urine receiving position from the person's front side between her body and a supporting seat surface to receive the urine and which is subsequently removed from such urine receiving position, the female person remaining seated the entire time, comprising:

a shallow, upwardly opening pan of a rounded pie-slice configuration with a generally flat bottom and a continuous swollen, bulbous cross-section lip around the periphery thereof, said pan having a radiused apex end and a larger radiused opposite end;

a perforated splash plate attached at an outer periphery thereof to a continuous inside portion of the bulbous lip, said splash plate extending generally parallel to the bottom of the pan and which along with said bottom and said bulbous lip define a lower reservoir therebetween for receiving urine through said perforated splash plate; and an elongate handle attached at one end to and extending from said opposite end of said pan in a direction opposite from said apex end, said handle being for gripping by a person to slide the urinal device into and out of the urine receiving position.

9. A urinal device according to claim 7, wherein the handle is angled upwardly from the end connected to the bulbous lip toward the opposite end thereof.

10. A urinal device according to claim 8, wherein a grip is disposed about at least a portion of the handle.

11. A urinal device according to claim 8, further comprising:

a connection tube connected to and extending from the pan generally adjacent to and below the handle, said connection tube which communicates between an interior and an exterior of said pan;

a urine receiving container; and a flexible hose which connects together said connection tube and said urine receiving container, which container receives and stores urine from said interior of said pan.

* * * * *